US006615618B2

(12) United States Patent
Kost

(10) Patent No.: US 6,615,618 B2
(45) Date of Patent: Sep. 9, 2003

(54) KNITTED FABRIC

(75) Inventor: David William Kost, Warwick (AU)

(73) Assignee: Gale Pacific Limited, Victoria (AU)

( * ) Notice: Subject to any disclaimer, the term of this patent is extended or adjusted under 35 U.S.C. 154(b) by 0 days.

(21) Appl. No.: 10/263,348

(22) Filed: Oct. 3, 2002

(65) Prior Publication Data

US 2003/0061839 A1 Apr. 3, 2003

(30) Foreign Application Priority Data

Oct. 3, 2001 (AU) ..... PR8067

(51) Int. Cl.[7] ..... D04B 23/08

(52) U.S. Cl. ..... 66/193; 66/195; 442/305; 442/314

(58) Field of Search ..... 66/190, 192, 193, 66/195; 442/305, 312, 313, 314

(56) References Cited

U.S. PATENT DOCUMENTS 4,067,209 A * 1/1978 Kucera et al. ..... 66/193
4,183,993 A * 1/1980 Benstead et al. ..... 442/314
4,425,398 A * 1/1984 Berczi ..... 442/314
4,518,640 A * 5/1985 Wilkens ..... 428/102
4,615,934 A * 10/1986 Ellison ..... 442/313
4,626,465 A * 12/1986 Henningsson ..... 442/186
4,787,219 A * 11/1988 Sato et al. ..... 66/190
5,433,991 A * 7/1995 Boyd, Jr. et al. ..... 428/193
6,389,851 B1 * 5/2002 Groshens ..... 66/192

OTHER PUBLICATIONS

*Green–House Curtain,* Patent Abridgment Document No. AU–B–22082/83, Australian Patent Office Acceptance No. 577033, Publication Date of Accepted Application Nov. 15, 1988.

* cited by examiner

*Primary Examiner*—Danny Worrell
(74) *Attorney, Agent, or Firm*—Lowe Hauptman Gilman & Berner, LLP

(57) ABSTRACT

A warp knitted fabric (1) including an open framework (2) of longitudinally and transversely extending knitted threads (3,4,5). The longitudinally extending threads (3) are spaced apart a predetermined distance (D). A plurality of material strips (9) laid in the open framework (2) along the spaces (8) between the longitudinally extending threads (3). The material strips (9) each have a width (W) which is greater than the predetermined distance (D) between adjacent longitudinally extending threads (3) so as to extend fully between the adjacent threads (3) and maintain that full extension upon lateral stretch of the fabric (1).

10 Claims, 2 Drawing Sheets

KNITTED FABRIC

BACKGROUND OF THE INVENTION

1. Field of the Invention

This invention relates generally to knitted fabric, and in particular to a warp knitted fabric incorporating laid-in strips of material. The fabric is applicable for use as a canopy in a covering structure in order to provide shade and other protective covering. It will be convenient to hereinafter disclose the invention in relation to that exemplary application, although it is to be appreciated that the invention is not limited thereto.

2. Description of the Prior Art

In a typical application, a knitted canopy fabric such as shade cloth is supported by a structure which extends over an agricultural or horticultural crop or orchard to be protected, or an area to be shaded or otherwise protected. The structures take a variety of forms, but have in common that it is desirable to stretch the fabric over the structure so that it remains taut in use.

One form of knitted fabric provides a plurality of longitudinally extending flexible strips laid into a knitted thread framework. The framework is formed by spaced apart longitudinal and transverse connection threads, Respective strips extend along the spaces defined between adjacent longitudinal connection threads, with the strips having a width that corresponds to the width of the spacing between those threads. The transverse connection threads extends across each side of the strips between the adjacent longitudinal connection threads so as to retain the strips in position. The strips are thermo-mechanically fixed to the framework to assist in that retention.

One such form of knitted fabric is disclosed in Australian patent 577033.

A warp knitted fabric tends to change dimension when stretched. Although thermosetting of the fabric following knitting dimensionally stabilises the fabric to a substantial extent, the significant forces applied to the fabric during installation to and support on a structure tends to cause further stretching. Where that stretching is in a lateral direction, i.e. transverse to the direction in which the fabric was knitted, then in the case of fabric incorporating laid in material strips gaps appear between the strip edges and longitudinal threads. As a result, the covering integrity of the fabric is compromised. In particular, the fabric looses its rated shade factor, and may also suffer a reduction in the ability to protect against, for example, hail.

SUMMARY OF THE INVENTION

An object of the present invention is to provide a knitted fabric incorporating laid in material strips which maintains its protective qualities when in use stretched over a support structure.

With that object in mind, the present invention provides a warped knitted fabric comprising:

an open framework of longitudinally and transversely extending knitted threads, the longitudinally extending threads being spaced apart a predetermined distance; and, a plurality of material strips laid in the open framework along the spaces between the longitudinally extending threads, the material strips each having a width which is greater than the predetermined distance between adjacent longitudinally extending threads so as to extend fully between the adjacent threads and maintain that full extension upon lateral stretch of the fabric.

Preferably, the knitted threads form an array of thread connections extending in parallel spaced apart rows along the longitudinally extending threads. The material strips preferably have opposed longitudinal edges that abut respective rows of the thread connections.

Preferably, the rows of thread connections are provided by pillar stitches.

Preferably, the material strips have opposed longitudinal faces, and the transversely extending threads extend across the spaces between the longitudinally extending threads and over the opposed faces.

Preferably, the threads extending across the spaces are provided by thread underlaps.

The material strips may extend along each space between the longitudinally extending threads. Alternatively, the material strips may extend along only some of those spaces between the longitudinally extending threads. Thus, in this alternative some individual spaces or groups of adjacent spaces may carry material strips and be interposed with individual or groups of spaces not carrying material strips.

Preferably, the material strips have a curved transverse profile. That profile tends to flatten toward a planar transverse profile upon lateral stretch of the fabric.

Preferably, the material strips have less longitudinal stretch than the framework thereby reducing overall longitudinal stretch of the fabric.

The threads are preferably composed of heat shrinkable plastic filament, and the fabric is heat shrunk thereby to thermo-mechanically fix the fabric.

DESCRIPTION OF THE DRAWINGS

The following description refers to a preferred embodiment of the knitted fabric of the present invention. To facilitate an understanding of the invention, reference is made in the description to the accompanying drawings where the fabric is illustrated in that preferred embodiment. It is to be understood that the fabric is not limited to the preferred embodiment as hereinafter described and as illustrated in the drawings.

In the drawings.

DETAILED DESCRIPTION OF PREFERRED EMBODIMENT OF THE INVENTION

Figure 1:
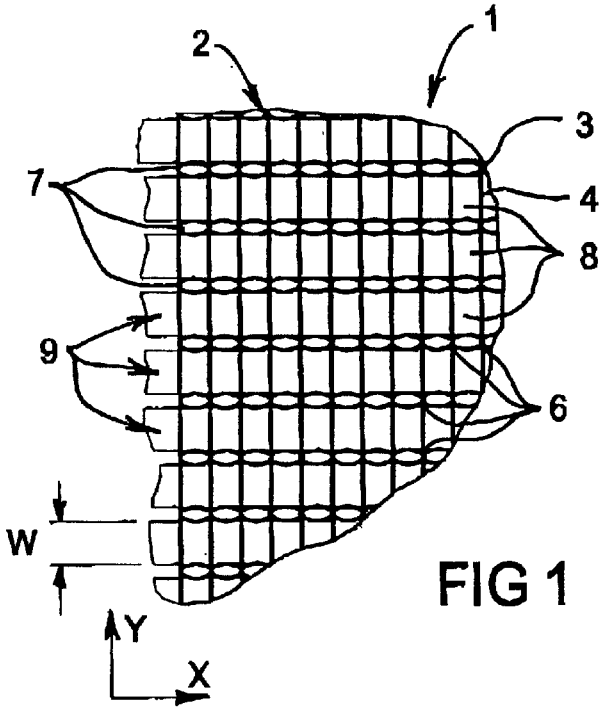
FIG. 1 is a schematic front view of a piece of warp knitted fabric according to a preferred embodiment of the present invention.
Figure 2:
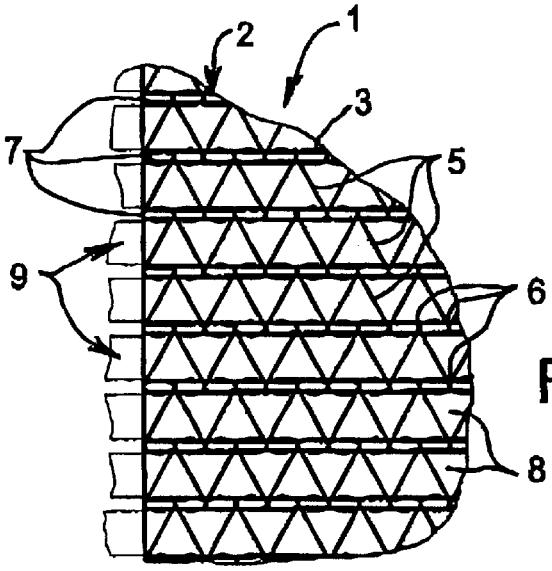
FIG. 2 is a schematic back view of the piece of warp knitted.
Figure 4:
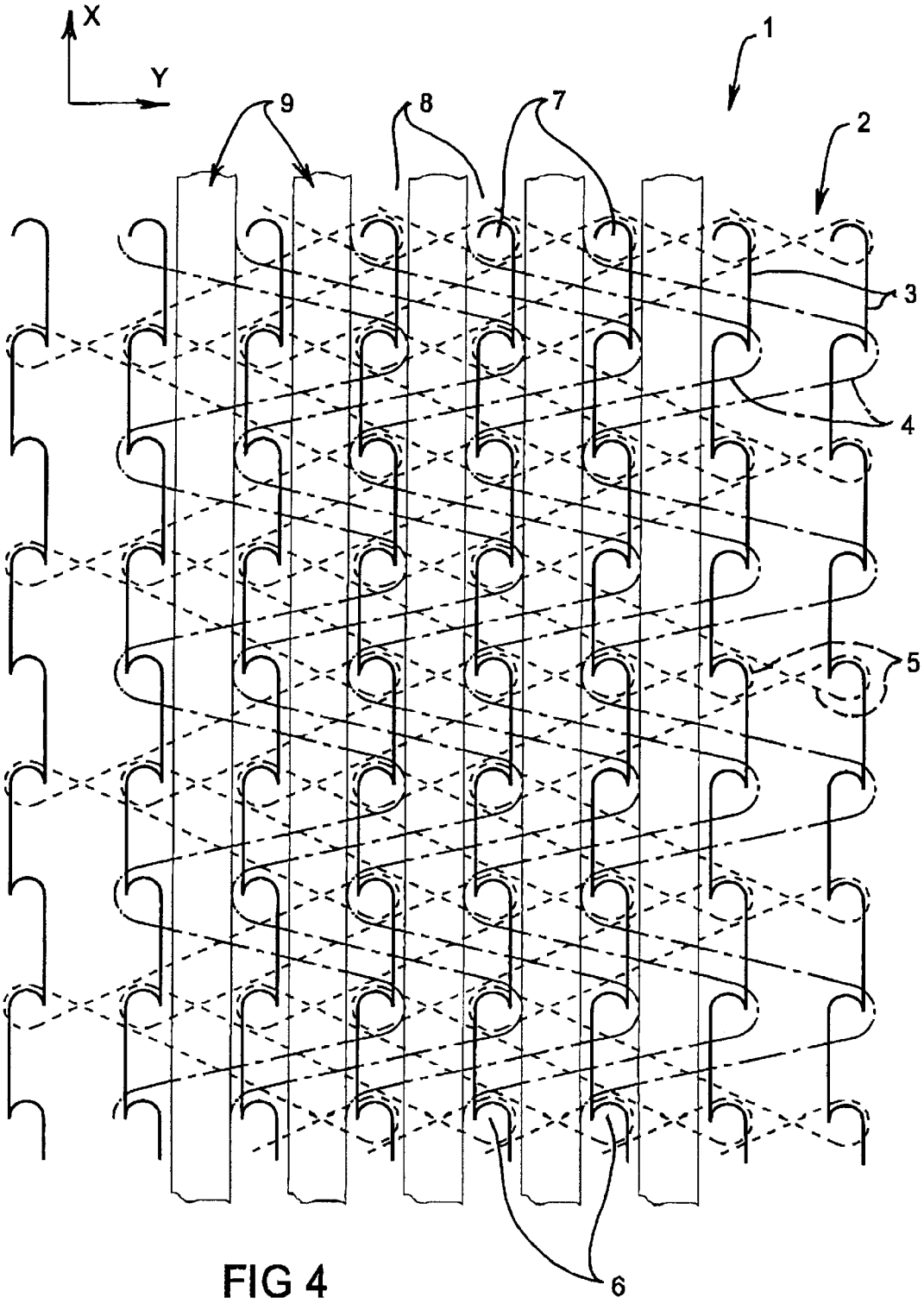
FIG. 4 is an enlarged scale front view of a section of the fabric piece of FIG. 1 showing the thread knit pattern.

Referring to the drawings, there is generally shown a piece of warp knitted fabric 1. The fabric 1 has an open framework 2 in the nature of mesh or net formed of a plurality of threads 3,4,5 knitted together in a predetermined knit pattern of those threads 3,4,5 and the mesh or net nature of the fabric 1 are best shown in FIGS. 1 and 2. In FIG. 4, the threads 3,4,5 are drawn in different line formations only to assist in distinguishing those threads. In particular, those different formations do not represent different types of thread.

The threads 3,4,5 are knitted together to form an array of thread connections 6. Those thread connections 6 extend in parallel, spaced apart rows 7 along the fabric and define longitudinal open spaces 8 between the rows 7 of thread connections 6. The threads 3 extend generally in a longitudinal direction X of the fabric 1 along the rows 7, whilst the threads 4,5 extend generally in a transverse direction Y of the fabric 1 across the spaces 8 between the rows 7.

As shown, the rows 7 of thread connections 6 are provided by pillar stitches, and the threads 4,5 extending across the spaces 8 between adjacent stitches are thread underlaps.

The rows 7 of thread connections 6 are spaced apart a predetermined distance D selected depending on the intended application of the fabric 1. In the exemplary application, that spacing distance D can be up to about 10 mm. In the embodiment shown, distance D is about 3 mm.

In this preferred embodiment, the threads 3,4,5 are knitted in the framework 2 using a multi-bar warp knitting machine (not shown). The longitudinally extending threads 3 are fed to the first or front bar, and the transversely extending threads 4,5 are fed to at least one successive bar, in a manner well understood by those skilled in the relevant knitting art. In one form, a four bar warp knitting machine is used, the transversely extending threads 4,5 being fed to the second and fourth (or back) bars. As will become more apparent hereinafter, the third bar will be used to feed material strips for laying into the framework 2 the material strips will be laid between the transversely extending threads 4,5 being fed from the two bars.

Each thread 3,4,5 is a monofilament, although it will be appreciated that two or more filaments may be twisted or drawn together in order to form each thread 3,4,5.

The threads 3,4,5 are composed of any material suitable to the intended application of the fabric 1. In the exemplary application, the threads 3,4,5 are composed of plastic filament. The plastic material is heat shrinkable to enable thermo-mechanical fixing of the fabric 1, as will be well understood by those skilled in the relevant art. Moreover, the plastic material exhibits properties, such as ultraviolet light stabilisation, to achieve acceptable performance in the exemplary application.

The fabric 1 also includes a plurality of material strips 9 laid in the framework 2 along the spaces 8 between the rows 7 of the thread connections 6. The material strips 9 have opposed faces 10 and longitudinal edges 11. Those strips 9 are supported in the framework 2 between the thread underlaps 4,5, extending over the opposed faces 10. More underlap threads 4,5 extend over the face 10 on the underside or backside (FIG. 2) of the fabric 1 than over the face 10 on the top side or front side (FIG. 1) of the fabric 1.

The material strips 9 have a width W between edges 11 which is greater than the spacing distance D between the rows 7 of the thread connections 6. As a result, the material strips 9 extend fully between and abut adjacent rows 7 of thread connections 6.

Figure 3:
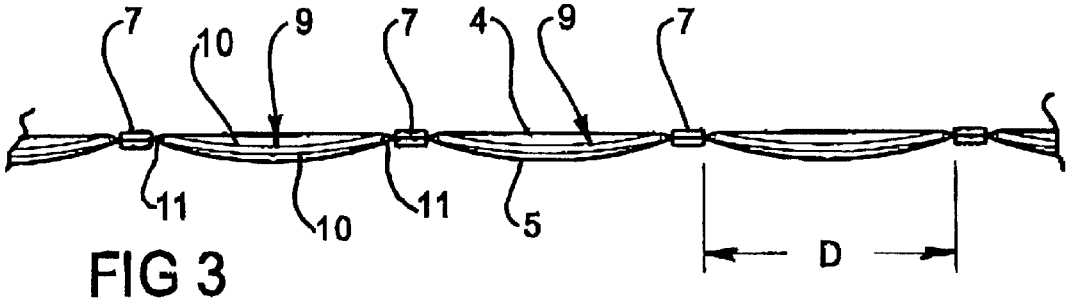
FIG. 3 is an enlarged schematic end view of he piece of warp knitted fabric of FIG. 1.

The oversize width W of the strips 9, relative to the spacing distance D causes the strips 9 to laterally deform prior to any lateral stretching of the fabric 1 upon and following installation. As shown in FIG. 3, the strips 9 can curve in a transverse profile between their longitudinal edges 11. The strips 9 all curve in the same direction as shown. That is achieved by applying relatively different tensions in the transversely extending threads 4 and 5. Thus, in this embodiment, thread 4 is knitted with a higher tension than is thread 5 so that the longitudinal edges 11 of the strips 9 are caused to bow upwardly under influence of the abutting rows 7 of the thread connections 6. As a result, the strips 9 form shallow channels along the one face 10 over which threads 4 extend. In use, the fabric 1 can be orientated with that one face 10 uppermost so that the channels function to collect water, such as rainwater, for runoff along the fabric 1.

The extent to which the material strips 9 are oversize in width W will depend on the extent to which the fabric 1 stretches laterally upon installation and in use. In one embodiment, that oversize is selected so that the strips 9 remain partially deformed even when the fabric 1 is fully stretched in normal use. In this way, the strips 9 will retain their shallow channel profile during that use. In an alternative embodiment, the oversize is selected so that the strips 9 are entirely laterally relieved, or flattened, and so adopt a generally planar profile, when the fabric 1 is fully stretched in normal use. In either embodiment, however, the longitudinal edges 11 of the strips 9 maintain their abutment with respective rows 7 of the thread connections 6.

In the exemplary application, the strips 9 have a width W of up to about 2 mm oversize compared with the spacing distance D. The actual oversize dimension will depend on the width of the strips 9 and spacing distance D, with narrow strips 9 and spacing distance D having an oversize dimension somewhat less than about 2 mm. Thus, where the spacing distance D is about 3 mm, then the strips 9 have a width W of between about 3.1 and 3.5 mm.

The strips 9 will extend continuously along the spaces 8. Typically the strips 9 will extend along each space 8, as shown. However, in particular applications not shown, it may be appropriate that strips 9 are omitted from some of the spaces 8. Where that occurs the strips 9 may be omitted from individual spaces 8 or from groups of adjacent spaces 8.

The strips 9 are composed of any material suitable to the intended application of the fabric 1. In particular, material may be selected with appropriate heat and light reflection, transmission and absorption properties. Those and other properties may be provided by individual or combinations of materials. Thus, the strips 9 may be composed of a single material, or a composition of two or more materials such as material laminates. In this embodiment, the strips 9 are composed of flexible material.

In one embodiment, the strips 9 are composed of plastics material, such as polyethylene, and in particular high density polyethylene.

The plastic material strips 9 are manufactured by cutting plastic sheet material. The sheet material may be extruded. Moreover, the material can be unstretched both in sheet and strip form. Thus, in one example, the high density polyethylene strips are unstretched prior to laying in the fabric framework 2.

The strips 9 have a thickness selected according to the intended application of the fabric. In the exemplary application, the polyethylene strips have a thickness of about 85 microns.

The fabric of the present invention maintains its protective qualities even when laterally stretched during normal installation and use. In particular, as the fabric is laterally stretched, and the spacing between adjacent rows of thread connections increase, the initially deformed material strips extending along those spaces laterally relieve with that stretching. As a result, the strips continue to extend fully or completely across the spaces with their longitudinal edges abutting the thread connections. Depending on the extent of stretching in the fabric, the material strips may completely relieve to a relaxed generally planar profile, or retain some of their deformed profile.

In one example fabric incorporating the present invention, the material strips have less stretch than the fabric framework in the longitudinal direction. In particular the material strips are less prone to stretching than the pillar stitches. As a result, when stretched over a support structure the fabric tends to remain taut even under the influence of winds so that reduced "flapping" of the fabric occurs when compared with existing similar fabrics.

Finally, it is to be understood that various alterations, modifications and/or additions may be made to the knitted fabric without departing from the ambit of the present invention as disclosed herein.

What is claimed is:

1. A warp knitted fabric comprising:

an open framework of longitudinally and transversely extending knitted threads, the longitudinally extending threads being spaced apart a predetermined distance; and, a plurality of material strips laid in the open framework along the spaces between the longitudinally extending threads, the material strips each having a width which is greater than the predetermined distance between adjacent longitudinally extending threads so as to extend fully between the adjacent threads and maintain that full extension upon lateral stretch of the fabric.

2. A fabric as claimed in claim 1, wherein the knitted threads form an array of thread connections extending in parallel spaced apart rows along the longitudinally extending threads, and the material strips have opposed longitudinal edges that abut respective rows of the thread connections.

3. A fabric as claimed in claim 2, wherein the rows of thread connections are provided by pillar stitches.

4. A fabric as claimed in claim 1, wherein the material strips have opposed longitudinal faces, and the transversely extending threads extend across the spaces between the longitudinally extending threads and over the opposed faces.

5. A fabric as claimed in claim 4, wherein the threads extending across the spaces are provided by thread underlaps.

6. A fabric as claimed in claim 1, wherein the material strips extend along each space between the longitudinally extending threads.

7. A fabric as claimed in claim 1, wherein the material strips extend along only some of the spaces between the longitudinally extending threads.

8. A fabric as claimed in claim 1, wherein the material strips have a curved transverse profile which tends to flatten toward a planar transverse profile upon lateral stretch of the fabric.

9. A fabric as claimed in claim 1, wherein the material strips have less longitudinal stretch than the framework thereby reducing overall longitudinal stretch of the fabric.

10. A fabric as claimed in claim 1, wherein the threads are composed of heat shrinkable plastic filament, and the fabric is heat shrunk thereby to thermo-mechanically fix the fabric.

* * * * *